US005860189A

United States Patent [19]

An

[11] Patent Number: 5,860,189

[45] Date of Patent: Jan. 19, 1999

[54] DOOR WHEEL

[76] Inventor: Tae-Heup An, 941-1503, Lotte Apartment Kungnaedong, Kunpo City, Kyoungkido, Rep. of Korea

[21] Appl. No.: 811,722

[22] Filed: Mar. 6, 1997

[51] Int. Cl.[6] ..... E05D 15/06

[52] U.S. Cl. ..... 16/91; 16/105; 49/425

[58] Field of Search ..... 16/32, 33, 34, 16/91, 99, 105; 49/420, 421, 425

[56] References Cited

U.S. PATENT DOCUMENTS

| | | | |
|---|---|---|---|
| 257,401 | 5/1882 | Somers | 16/105 |
| 2,668,318 | 2/1954 | Le Bon III | 49/425 |
| 3,040,391 | 6/1962 | Saunders | 49/425 |
| 3,237,238 | 3/1966 | Anderson | 16/105 |
| 3,298,136 | 1/1967 | Saunders | 49/425 |
| 3,443,340 | 5/1969 | Helmick et al. | 16/91 |
| 3,826,044 | 7/1974 | Armstrong | 16/91 |

FOREIGN PATENT DOCUMENTS

| | | | |
|---|---|---|---|
| 2441041 | 7/1980 | France | 49/425 |
| 2455399 | 5/1975 | Germany | 16/105 |
| 2039916 | 8/1986 | United Kingdom | 49/425 |

*Primary Examiner*—Chuck Y. Mah
*Assistant Examiner*—Donald M. Gurley
*Attorney, Agent, or Firm*—Oblon, Spivak, McClelland, Maier & Neustadt, P.C.

[57] ABSTRACT

A door wheel includes a casing approximately having a form of "⊓", a climbing frame approximately having a form of isosceles triangle and a portion of which is rotatably fixed on the casing, a roller rotatably installed on the climbing frame, a wedge approximately having a form of right-angled triangle and the inclined surface of which is adjacent to the surface corresponding to the fixed end of the climbing frame and which can be rectilinearly moved in the casing, and a control screw which is rotatably installed in the casing to rectilinearly move the wedge and one end of which is coupled with the wedge. The free end of the climbing frame can be climbed together with the roller by moving the wedge through rotating the control screw.

8 Claims, 3 Drawing Sheets

DOOR WHEEL

BACKGROUND OF THE INVENTION

1. Field of the Invention

The present invention relates to a door wheel which is placed under the bottom of a sliding door frame to smoothly move the door along the door rail.

2. Discussion of Related Art

Generally, a sliding door is open or closed by moving the door frame, coupled between the upper and lower portions of the door casing, along the door rail. The door frame is manufactured to be large enough to easily couple or separate it with or from the door casing. A door wheel having a roller is provided under the bottom of the door frame to smoothly move it.

In the sliding door, since the door is loosely coupled with the door casing, the door may be swayed due to the external power like wind or it may be even broken away from the door casing. Thus, a method of controlling the height of the door wheel has been developed to prevent the door from swaying. But, the conventional door wheel has a problem in its durability due to its weak coupling structure.

SUMMARY OF THE INVENTION

Accordingly, the present invention is directed to a door wheel which substantially obviates one or more of the problems due to limitations and disadvantages of the related art.

An object of the present invention is to provide a door wheel whose climbing movements can be easily controlled and its durability can be greatly elevated.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the door wheel according to the present invention includes a casing approximately having a form of "⊓", a climbing frame approximately having a form of isosceles triangle and a portion of which is rotatably fixed on the casing, a roller rotatably installed in the climbing frame, a wedge approximately having a form of right-angled triangle and which can be rectilinearly moved in the casing and the inclined surface of which is adjacent to the surface corresponding to the fixed end of the climbing frame, and a control screw which is rotatably installed in the casing to rectilinearly move the wedge and one end of which is coupled with the wedge by the screw. The free end of the climbing frame can be climbed together with the roller by moving the wedge through rotating the control screw. More advantageously, the wedge is slantly moved up and down while the control screw is directed toward the lower end of the casing. In addition, a spring is installed between the casing and the climbing frame to make the climbing frame elastically adhere to the wedge.

When the door installing with the inventive door wheel is coupled with the door casing and the door wheel is heightened, the gap between the door casing and the door frame is minimized so that it is possible to prevent the door from swaying.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

Figure 1:
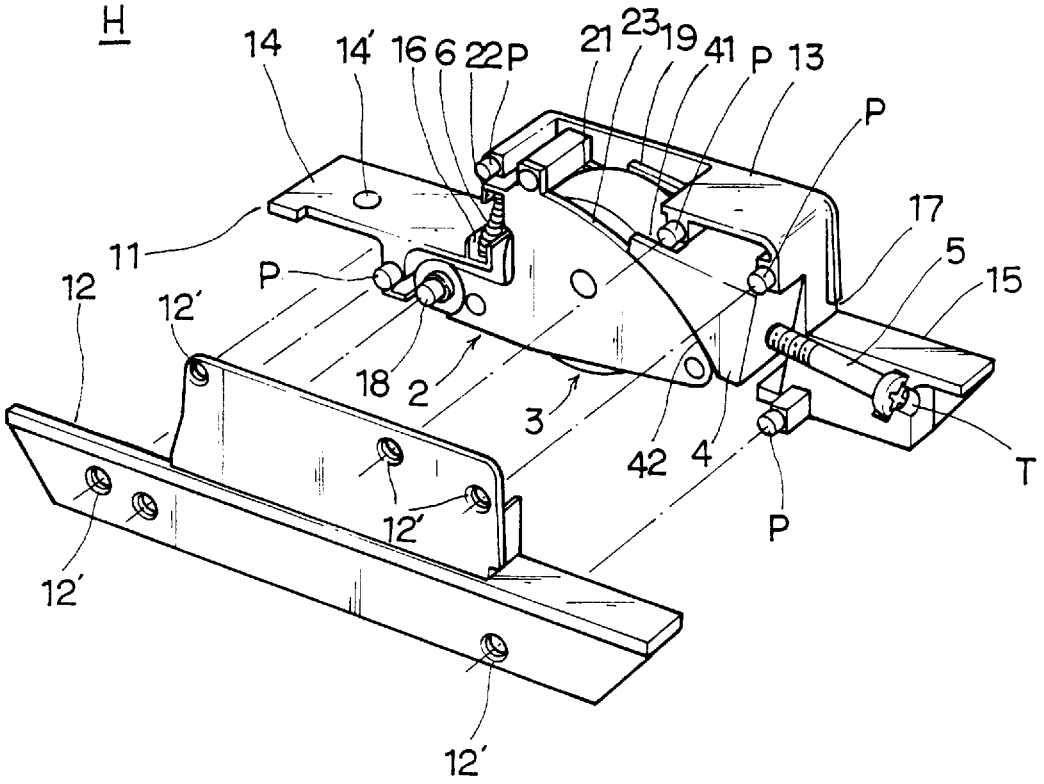
FIG. 1 is a perspective view of a door wheel according to the present invention.

As illustrated in FIG. 1, the inventive door wheel H includes a casing 1 for installing and supporting each component therein. The casing 1 is composed of a body 11 and a cover 12. The body 11 is provided with a top 13 having a block-shape and fixing plates 14 and 15. The top 13 opens from its inner side to its front and lower sides. The fixing plates 14 and 15 each are formed adjacent to the longitudinal sides of the top 13. A spring groove 16 is formed on the corner between the top 13 and the fixing plate 14 while a junction groove 17 is formed on the corner between the top 13 and other fixing plate 15. Furthermore, a central shaft 18 is formed under the spring groove 16 and a guide projection 19 is slantly formed in the upper part of the top 13 up and down. A control screw groove T is formed on the fixing plate 15 parallel to the guide projection 19.

The door wheel also includes a climbing frame 2 for climbing the roller while fixing it. The climbing frame 2 approximately has a form of isosceles triangle. A space 21 is formed in the climbing frame while a spring groove 22 is formed between its upper and lower portions. A sliding surface 23 is externally formed between the upper and other lower portions. The lower portion of the climbing frame 2 is rotatably connected with the central shaft 18 of the body 11. A roller 3 is rotatably placed in the inner space of the climbing frame 2.

The door wheel further includes a wedge 4 for climbing the climbing frame 2 by its rectilinear movement. The wedge 4 approximately has a form of right-angled triangle. A space 41 being capable of receiving the roller 3 is formed in the wedge. The inclined surface of the wedge is formed with a sliding surface 42 having a form corresponding to the sliding surface 23 of the climbing frame 2. The wedge 4 is coupled between the guide projection 19 and the climbing frame 2. In the coupling structure, the sliding surface 42 is adjacent to the sliding surface of the climbing frame 2.

In addition, the door wheel includes a control screw 5 for rectilinearly moving the wedge 4. The control screw 5 is rotatably inserted into the control screw groove T formed on the body 11. One end of the control screw is connected to one side of the wedge 4.

Reference numeral 6 indicates a spring inserted between the spring groove 16 formed on the body 11 and the spring groove 22 formed on the climbing frame 2 to make the climbing frame 2 adhere to the wedge 4. Reference numeral 14' indicates a fixture formed on the fixing plate 14 of the body 11. Reference character P indicates junction pins projected toward the front side of the body 11.

Reference numeral 12 indicates a cover for covering the front side of the body 11. A pin hole 12' is formed on the portion of the cover 12 corresponding to the junction pin P formed on the body 11. The cover 12 is connected with the body 11 by extending its dimensions through striking the front end of the junction pin P projected from the pin hole 12' after inserting the pin hole 12' into the junction pin P of the body 11.

According to the above construction, when the wedge 4 is upwardly moved in the inclining direction (the arrow L of FIG. 2) along the guide projection 19 by rotating the control screw 5, the free end of the climbing frame 2 is downwardly moved together with the roller 3 through pushing the guide surface 23 of the climbing frame 2 with the sliding surface 42 of the wedge 4. When the wedge 4 is downwardly moved in the inclining direction (the arrow R of FIG. 2) along the guide projection 19 by rotating the control screw 5, the free end of the climbing frame 2 is upwardly moved together with the roller 3 by elasticity of the spring 6. As a result, the height of the door wheel H can be very easily controlled by controlling the rotation of the control screw 5.

The installation process of the inventive door wheel will be described with reference to FIGS. 2 and 4.

Figure 2:
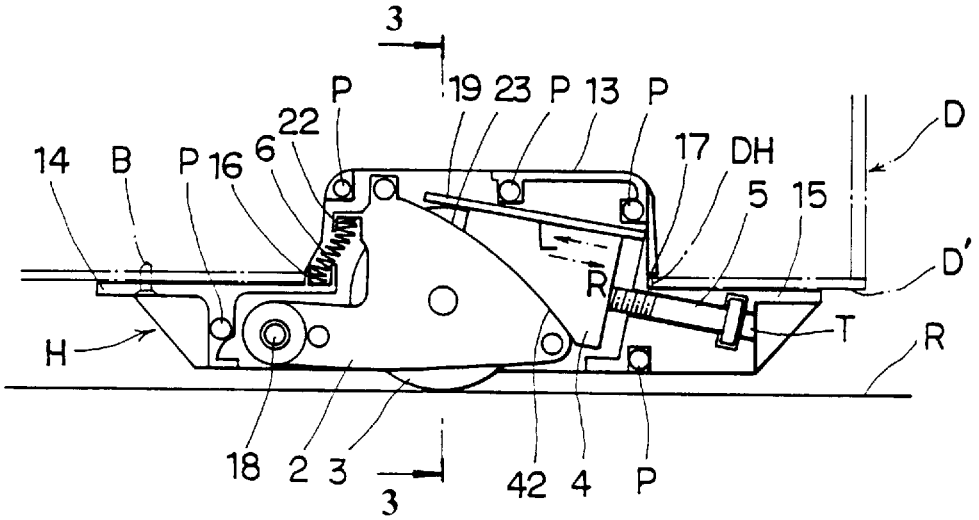
FIG. 2 is a front view of the door wheel installed under the lower frame of the door.
Figure 3:
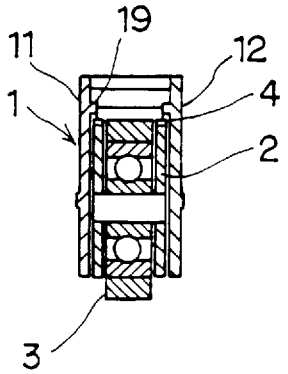
FIG. 3 is a cross-sectional view of A—A line of FIG. 2.

As illustrated in FIG. 2, the top 13 of the casing 1 is inserted into the junction hole DH formed on the lower frame D' of the door D. Then, the junction groove 17 is inserted into the longitudinal front end of the junction hole DH. Subsequently, the fixture B is fixed through the fixing hole 14' formed on the fixing plate 14. As illustrated in FIG. 2, when the door D installed with the door wheel H is coupled with the door casing (not shown) , the coupling process is performed with a low height of the door wheel H. As described above, the height of the door wheel H can be lowered by rotating the control screw 5 to downwardly move the wedge 4. The door D is coupled to the door casing with a low height of the door wheel H because the coupling operation can be easily performed through reducing the length from the upper end of the door D to the lower end of the door wheel H.

Figure 4:
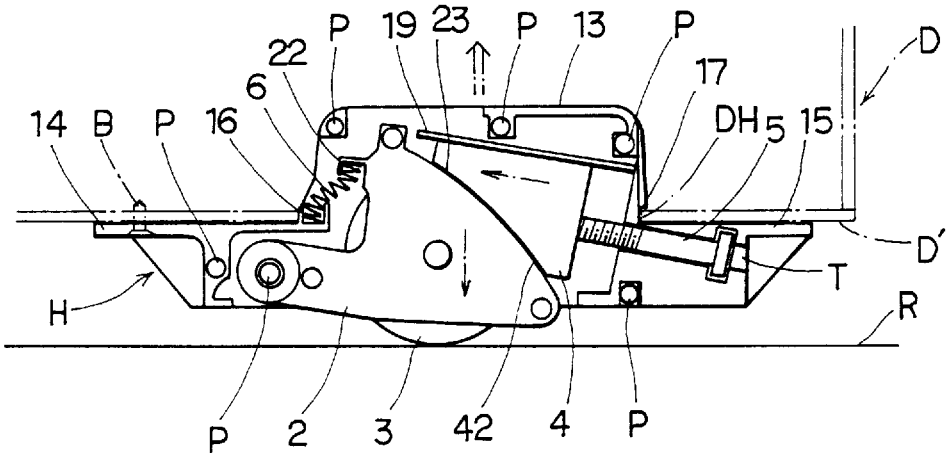
FIG. 4 is a front view of the door wheel whose height is in a high state.

In the meantime, as illustrated in FIG. 4, when the door is coupled with the door casing while the control screw 5 of the door wheel H is reversely rotated and the wedge 4 is upwardly moved in the inclining direction, the height of the door wheel H is elevated. As a result, since the gap between the upper end of the door D and the door casing is shortened, the door D can be freely moved (Reference numeral R indicates a rail formed on the door casing).

As described above, since the height of the inventive door wheel can be lowered by rotating the control screw, the door installed with the door wheel can be easily coupled with the door casing. Furthermore, since the gap between the upper end of the door and the door casing is shortened so that the door can be freely moved, the door is not swayed or broken away from the door casing. Also, since the control screw can be rotated under the lower frame of the door, a tool inserting hole for rotating the control screw need not be punched. Thus, the installation operation and the height control can be easily performed. In addition, since the inventive door wheel is structurally simple and rigid, the production cost is lowered and its durability can be largely improved.

It will be apparent to those skilled in the art that various modifications and variations can be made in the door wheel of the present invention without departing from the spirit or scope of the invention. Thus, it is intended that the present invention cover the modifications and variations of this invention provided they come within the scope of the appended claims and their equivalents.

What is claimed is:

1. A door wheel comprising:

a casing having an inverted U-shape including a body and a cover releasably fixed to a front side of said body, said casing being insertable into a junction hole of a lower door frame;

a climbing frame mounted in said casing, said climbing frame including at least two side plates connected to each other in a spaced relationship, said side plates being in the shape of isosceles triangles with upper edges of said side plates forming a guide surface, said climbing frame being pivotally supported at one end by said body;

a roller mounted for rotation between said side plates;

a control screw rotatably mounted in said casing;

a wedge having the shape of a right triangle and being rectilinearly movable within said body wherein a lower inclined surface of said wedge is a sliding surface in contact with said guide surface at a free end of said climbing frame;

said control screw being connected to said wedge to cause rectilinear movement of the wedge when said control screw is rotated, said wedge pivoting said climbing frame in a vertical direction in response to movement of the wedge.

2. Door wheel according to claim 1, wherein said wedge is moved vertically at a slant while the control screw is directed toward the lower side of the casing.

3. Door wheel according to claims 1 or 2, wherein a spring is installed between the body and the climbing frame to elastically press the guide surface against the sliding surface.

4. Door wheel according to claims 1 or 2, wherein a plurality of junction pins project from said body toward said cover, said cover including pin holes for receiving said pins and connecting the cover with the body.

5. Door wheel according to claims 1 or 2, wherein said body includes a top having block shape and fixing plates extending from longitudinal sides of said top.

6. Door wheel according to claim 5, wherein a guide projection is formed at a slant in an upper part of said top, said wedge being guided between said guide projection and said guide surface.

7. Door wheel according to claim 6, wherein a control screw groove is formed in one of said fixing plates and arranged parallel to the guide projection for receiving said control screw.

8. Door wheel according to claim 5, wherein a junction groove is formed on a corner between said top and one of said fixing plates, said junction groove being inserted into a longitudinal front end of said junction hole.

* * * * *